US010381737B2

(12) United States Patent
Tawk et al.

(10) Patent No.: US 10,381,737 B2
(45) Date of Patent: Aug. 13, 2019

(54) 3D PRINTED MINIATURIZED QUADRIFILAR HELIX ANTENNA

(71) Applicants: Youssef Antoine Tawk, Albuquerque, NM (US); Christos G. Christodoulou, Albuquerque, NM (US); Joseph Costantine, Fullerton, CA (US); Michel Chahoud, Zouk Mosbeh (LB); Marwan Fadous, Zouk Mosbeh (LB)

(72) Inventors: Youssef Antoine Tawk, Albuquerque, NM (US); Christos G. Christodoulou, Albuquerque, NM (US); Joseph Costantine, Fullerton, CA (US); Michel Chahoud, Zouk Mosbeh (LB); Marwan Fadous, Zouk Mosbeh (LB)

(73) Assignee: STC.UNM, Albuquerque, NM (US)

( * ) Notice: Subject to any disclaimer, the term of this patent is extended or adjusted under 35 U.S.C. 154(b) by 25 days.

(21) Appl. No.: 15/706,483

(22) Filed: Sep. 15, 2017

(65) Prior Publication Data

US 2018/0076528 A1 Mar. 15, 2018

Related U.S. Application Data

(60) Provisional application No. 62/394,916, filed on Sep. 15, 2016.

(51) Int. Cl.

| | |
|---|---|
| ***H01Q 1/36*** | (2006.01) |
| ***H01Q 11/08*** | (2006.01) |
| ***H01Q 15/16*** | (2006.01) |
| ***H01Q 19/10*** | (2006.01) |

(52) U.S. Cl.

CPC ..... *H01Q 11/08* (2013.01); *H01Q 1/362* (2013.01); *H01Q 15/16* (2013.01); *H01Q 19/10* (2013.01)

(58) Field of Classification Search

None

See application file for complete search history.

(56) References Cited

U.S. PATENT DOCUMENTS

| | | | | |
|---|---|---|---|---|
| 3,932,876 A * | 1/1976 | Ben-Dov | H01Q 11/08 | 343/895 |
| 5,329,287 A * | 7/1994 | Strickland | H01Q 11/08 | 343/752 |
| 6,075,501 A * | 6/2000 | Kuramoto | H01Q 11/08 | 343/853 |
| 2003/0164805 A1* | 9/2003 | Strickland | H01Q 21/067 | 343/895 |
| 2008/0174501 A1* | 7/2008 | Licul | H01Q 11/08 | 343/703 |

* cited by examiner

*Primary Examiner* — Howard Williams

(74) *Attorney, Agent, or Firm* — Vogt IP; Keith A. Vogt

(57) ABSTRACT

The present invention provides an antenna miniaturized topology that is based on the implementation of a conductive loading on a quadrifilar helix antenna. This may be achieved by connecting the tip of the four helical arms to end members which may be circular planar conductors. The miniaturization of the antenna may be further enhanced by incorporating a dielectric material in the space between the four arms.

25 Claims, 12 Drawing Sheets

| | f[MHZ] | Max. Gain | Back Lobe |
|---|---|---|---|
| Square | 897 | 6.11 dB | 0.28 |
| *L=6 cm* | 882 | 6.84 dB | -1.86 |
| *L=8 cm* | 873 | 6.73 dB | -2.82 |
| ***L=10 cm*** | **867** | **6.28 db** | **-4.06** |
| *L=12 cm* | 858 | 5.48 dB | -4.9 |

Square Ground
6 cm
8 cm
10 cm
12 cm

3D PRINTED MINIATURIZED QUADRIFILAR HELIX ANTENNA

RELATED APPLICATIONS

This application claims the benefit of U.S. Provisional Application No. 62/394,916, filed Sep. 15, 2016, and herein incorporated by reference.

STATEMENT REGARDING FEDERALLY SPONSORED RESEARCH & DEVELOPMENT

Not applicable.

INCORPORATION BY REFERENCE OF MATERIAL SUBMITTED ON A COMPACT DISC

Not applicable.

BACKGROUND OF THE INVENTION

The 3D printing technology is opening new capabilities and horizons to various engineering disciplines. In the area of antenna theory, such technology facilitates the fabrication process and enables a high level of accuracy in the design especially for non-planar and volumetric structures.

A quadrifilar helix antenna is one of the most common structures that fall under the category of circularly polarized radiating structures with an end-fire radiation pattern. The sense of circular polarization, whether left or right handed, is dependent on the winding direction of the four helical arms that constitute the antenna. It also depends on the 90-degree progressive phase shift between the four arms. On the other hand, the antenna's ground plane plays a role in shaping and directing the radiation pattern.

Different miniaturization techniques have been used for this type of antennas. These techniques include the reduction of the antenna height by winding the helical arms using sinusoidal profiles, periodic triangular, fractal profiles or nonlinear functions. The implementation of stepped-width helical arms, the incorporation of dielectric rods, the variation of the pitch and turn angles of the helices, the insertion of gaps as well as the folding of the helical arms have been used for miniaturization purpose.

In other efforts, a folded printed quadrifilar helix antenna wherein a miniaturization of about 43% of the antenna's axial length is obtained by meandering and turning the helix arms into the form of square spirals. A length reduction of 15% is achieved without significantly degrading the antenna's bandwidth. The length reduction is attained by modifying the geometry at the center of the helices through the insertion of a gap and folding a short length of the conductor around the cylindrical surface.

In yet other efforts, the turn angles of the helices are employed for the axial length reduction of a half wavelength quadrifilar helix antenna. The use of a combination of sinusoidal profiles for the helical wires has been used.

Various miniaturization techniques have also been implemented on different antenna structures other than the quadrifilar helix. A volumetric miniaturization may be achieved through the adoption of a combination of z-directed meandering of a spiral antenna in addition to a tapered substrate profile. The use of interdigitated slits on a CPW-fed ring slot antenna has also been used. The addition of multiple slits enables the antenna to approximately reach the electrically small limit. The design of complementary split-ring resonators placed horizontally between the microstrip antenna and ground plane has also been shown to be a possible miniaturization technique.

BRIEF SUMMARY OF THE INVENTION

In one embodiment, the present invention provides an antenna miniaturized topology that is based on the implementation of a conductive loading on a quadrifilar helix antenna. This may be achieved by connecting the tip of the four helical arms to end members which may be circular planar conductors. The miniaturization of the antenna may be further enhanced by incorporating a dielectric material in the space between the four arms. These two miniaturization techniques are combined and collectively applied to lower the antenna's operating frequency without affecting its gain or radiation characteristics.

In another embodiment, the present invention provides a new optimized conical shaped ground plane. Such a ground plane constitutes a substitute for the typical planar ground plane that is usually incorporated with similar antenna structures. The conical ground plane contributes to the additional antenna compact size while shaping and redirecting its gain pattern and polarization scheme.

In other embodiments, the present invention provides a novel design and method of manufacturing an antenna such as a quadrifilar helix antenna using 3D printing as well as other additive and subtractive manufacturing procedures. The antenna is miniaturized by loading the tip of each helix by metallic circles of equal dimensions. The effect of decreasing the resonant frequency is also achieved by introducing a dielectric material within the antenna's physical structure.

In other embodiments, the present invention provides a 3D printed antenna structure that exhibits accurate radiation characteristics in terms of operating frequency, polarization, and gain.

In other embodiments, the present invention provides a quadrifilar helix antenna comprising a plurality of arms, each arm is printed using additive printing technology (3D printing).

In other embodiments, the present invention provides an antenna designed to operate within the UHF (ultra-high frequency) band of the spectrum.

In other embodiments, the present invention provides a design wherein each arm of the quadrifilar helix that is 3D printed is composed of a plastic dielectric and coated by a metallic layer.

In other embodiments, the present invention provides a design wherein each arm of the quadrifilar helix is terminated by a circular conductive disk that contributes to the miniaturization of the antenna.

In other embodiments, the present invention provides a design wherein the antenna structure is also loaded by FR-4 dielectric slabs that are positioned in the empty space between the four arms.

In other embodiments, the present invention provides a design wherein the circular conductive disks result in a 43% reduction in the total length of the four arms that constitute the antenna.

In other embodiments, the present invention provides an antenna having a ground plane that is conically shaped and optimized to further direct the antenna beam.

In other embodiments, the present invention provides a miniaturized antenna that maintains a left handed circular polarized behavior over the entire operational bandwidth.

In other embodiments, the present invention provides a miniaturized antenna that radiates an end-fire radiation where the maximum is directed toward the antenna's axis.

In other embodiments, the present invention provides a miniaturized antenna that realizes a maximum gain of 6.4 dB with an axial ratio below 3 dB across the full operation bandwidth and the total beamwidth.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

In the drawings, which are not necessarily drawn to scale, like numerals may describe substantially similar components throughout the several views. Like numerals having different letter suffixes may represent different instances of substantially similar components. The drawings illustrate generally, by way of example, but not by way of limitation, a detailed description of certain embodiments discussed in the present document.

DETAILED DESCRIPTION OF THE INVENTION

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a representative basis for teaching one skilled in the art to variously employ the present invention in virtually any appropriately detailed method, structure or system. Further, the terms and phrases used herein are not intended to be limiting, but rather to provide an understandable description of the invention.

Figure 1:
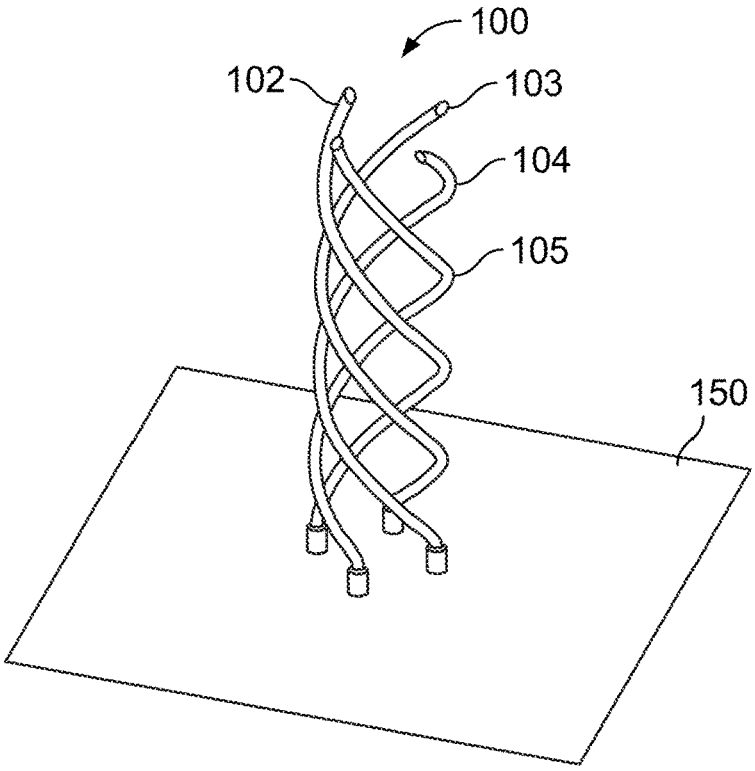
FIG. 1 illustrates a quadrifilar helix antenna for an embodiment of the present invention.

In one preferred embodiment of the present invention, a quadrifilar helix antenna 100 is provided as shown FIG. 1. The quadrifilar helix antenna is composed of four helical arms 102-105 that are equally spaced circumferentially along a cylinder. Six different parameters govern the operation of a quadrifilar helix antenna. These parameters are: (1) the helix diameter of the four arms, (2) the helix spacing of each of the four arms, (3) the number of turns of each arm, (4) the wire diameter, (5) the phase difference between the arms, and (6) the dimensions of the ground plane.

For an embodiment designed to operate at 930 MHz, the antenna may have a helix diameter $H_d$=4.547 cm and a wire diameter of 0.5 cm. The number of turns of each of the four helical arms is N=1.1. The helix pitch is $H_p$=14.632 cm so that the total antenna length is $L_t$=16.1 cm ($N \times H_p$), which corresponds to half-wavelength at 930 MHz.

The helix angle of each arm is about 73°. The direction of the winding of the four arms is taken to be in the clockwise direction (left handed) and the 90° increase in the phase shift between the input ports of the four arms is assigned in the counter clockwise direction.

The ground plane size is crucial to the functioning of the quadrifilar helix antenna. The size determines the direction of radiation, the resulting polarization, the beamwidth and the realized gain of the antenna structure.

The ground plane may be square in shape. The antenna maintains almost the same operating bandwidth for different values of $L_g$ (6.3 cm, 10 cm, 13 cm, and 16 cm) with a slight noticeable shift in the resonant frequency. However, the effect of the ground plane is more substantial and apparent on the polarization scheme and the radiation direction of the antenna.

For $L_g$=6.3 cm, the antenna is right hand circularly polarized with the main beam directed towards the −z-direction. This is observed due to the fact that the winding of the four helical arms and the progressive phase shift at the input ports of the four arms are in opposite directions. As the ground plane dimensions' increase, more of the radiated fields get reflected towards the +z-direction. For $L_g$=16 cm, the antenna becomes left hand circularly polarized with the main beam directed towards the +z-axis. For this case, the total maximum gain is 5.79 dB.

Figure 2:
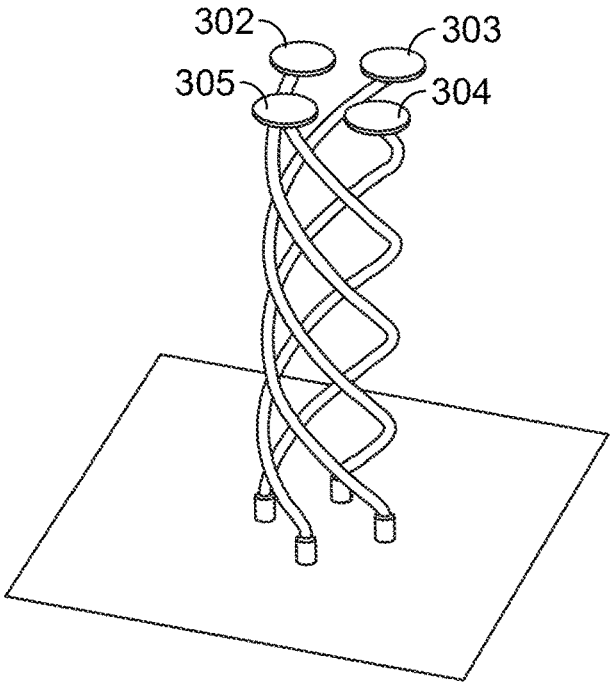
FIG. 2 provides a miniaturized antenna design that is loaded with centered conductive members in the shape of disks for another embodiment of the present invention.

In another embodiment of the present invention, as shown in FIG. 2, each helical arm may include elements or members 302-305 at the distal ends to load the antenna at the top. Loading at the top end has the effect of increasing the antenna's volume which in turn reduces the frequency of operation. The elements force the antenna to operate at a lower frequency band.

For embodiments using disk elements, the elements may be positioned in a way that their respective centers are connected to the tip of the four helical arms as shown in FIG. 2. Four different radii for the circular elements may be used ($r_{center}$=1, 1.2, 1.4 and 1.6 cm). Increasing $r_{center}$ beyond 1.6 cm forces the four circles to intersect which deteriorates the antenna's matching conditions.

In a preferred embodiment, the elements are planar, circular shaped and have an outer surface comprised of a metal such as copper. The center of each element intersects with the tip of the corresponding helix.

In embodiments using circular elements, different radii, such as r=1, 1.2, 1.4 and 1.6 cm, may be used. In yet other embodiments, the tip of the helical arms may be loaded with circularly shaped copper pieces. Three different radii (1.5, 2, and 2.5 cm) may also be used.

Figure 3A:
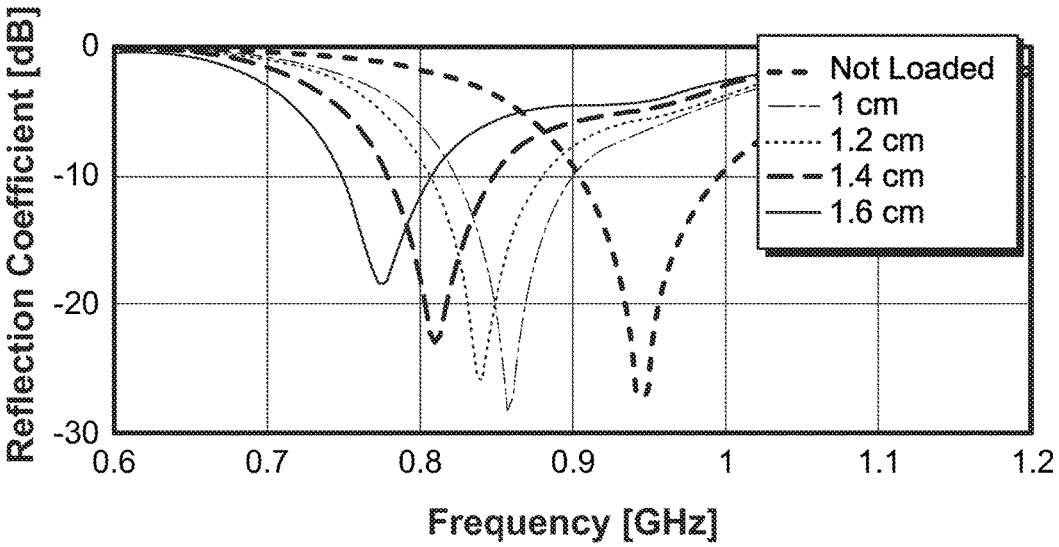
FIG. 3A shows the change in the antenna reflection coefficient due to the loading of the helical arms with the centered conductive circular disks.

The change in the antenna's reflection coefficient as a function of $r_{center}$ is summarized in FIG. 3A. The resonant frequency decreases from 945 MHz (no loading) to 774 MHz. The antenna preserves its matching for all the different cases, however the magnitude of the reflection coefficient increases from −28 dB to −18 dB. Such behavior can be related to the change in the antenna's input impedance. It is noticed that the loading of the helical arms has two effects on the antenna's input impedance. The first effect is related to the decrease in the real part of the input impedance within the antenna's operating bandwidth. This increases the magnitude of the reflection coefficient to −18 dB. The second effect is manifested by the change in the imaginary part of the input impedance. The input impedance is closest to the center of the smith chart at 945 MHz when the antenna is not loaded and at 774 MHz when the antenna is loaded with a circular conductive disk that has a radius of 1.6 cm. Such rotation on the smith chart is due to the shunt capacitive loading of the four circular elements on the antenna's input impedance.

Figure 3B:
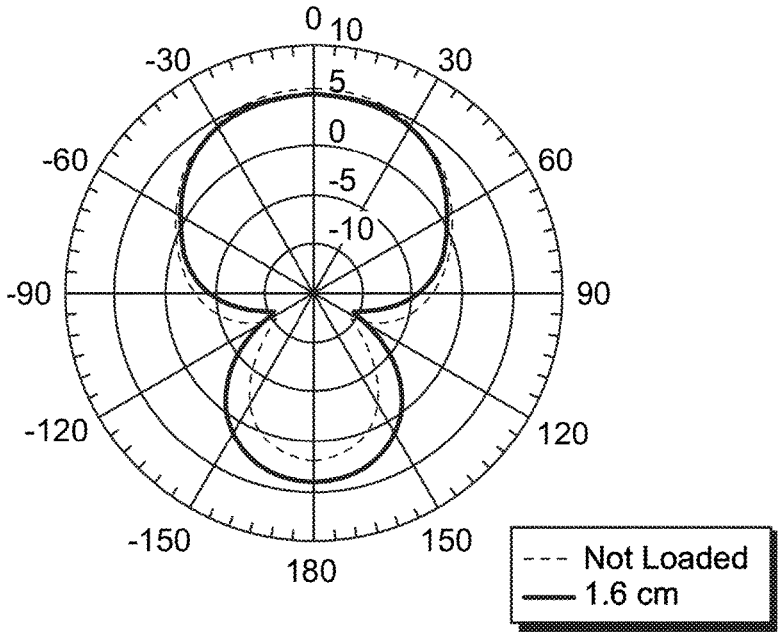
FIG. 3B shows the change in the 2D total gain pattern along the XZ plane of the embodiment shown in FIG. 3A.

FIG. 3B shows the 2D total gain pattern along the XZ plane when the antenna is not loaded and for the case when $r_{center}$=1.6 cm. For the different operating frequencies, the antenna preserves its maximum gain level of 5.7 dB along the +z-direction. However, the level of the back lobe total gain at θ=180° increases from 1.72 dB to 3.9 dB. This is obtained since the ground plane becomes electrically smaller as the operating frequency decreases.

Figure 4:
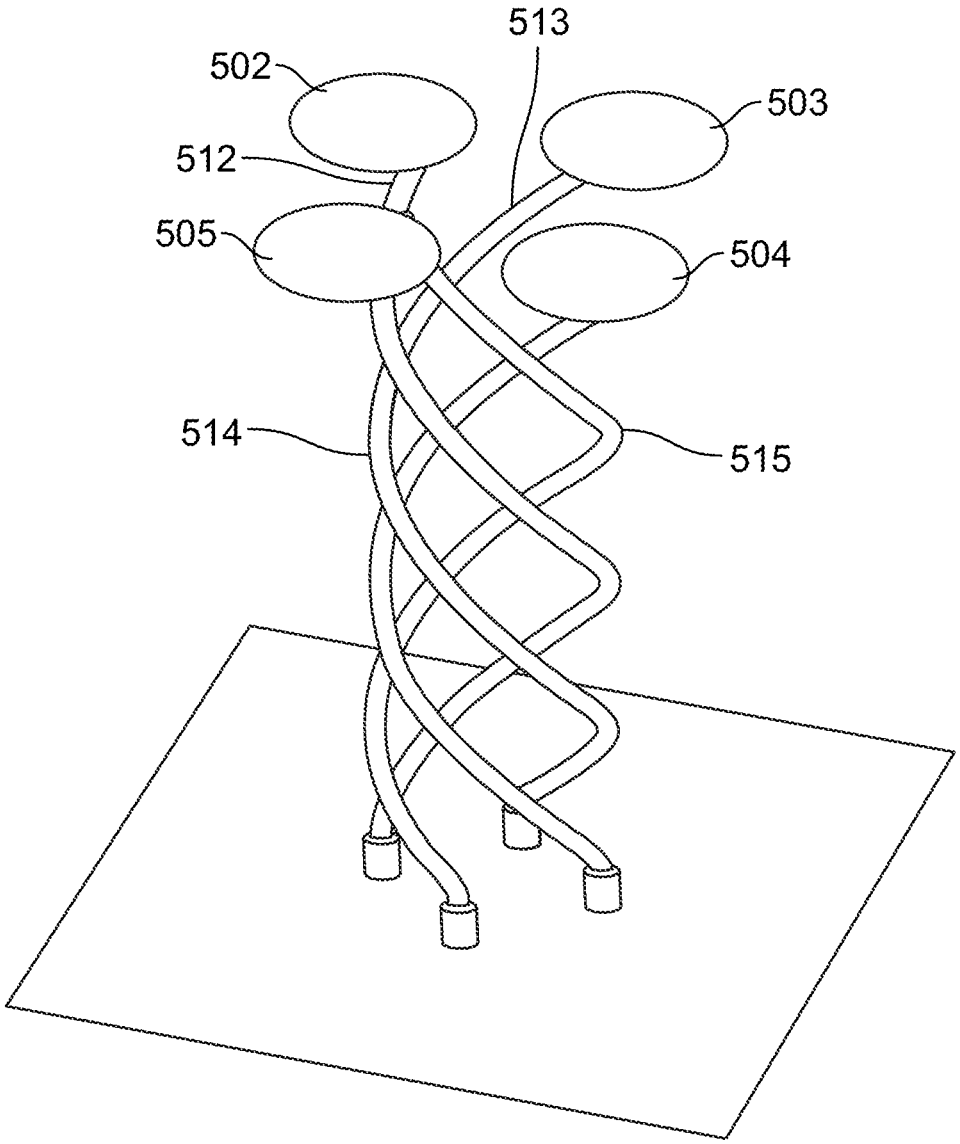
FIG. 4 provides an antenna design with offset loaded conductive members for another embodiment of the present invention.

FIG. 4 shows another embodiment of the present invention in which the edge of each element 502-505 intersects with the tip of the corresponding helix arm 512-515. This locates each element in a position that is offset from center. Also, the elements may be configured as described above. The offset positioning allows further increase in the circular elements' radii and thus a lower operating frequency is achieved. The radius of the circular element may be $r_{offset}$=2 cm, 2.5 cm and 3 cm where the tip of the helical arms is now at the edge of the circular loading.

Figure 5A:
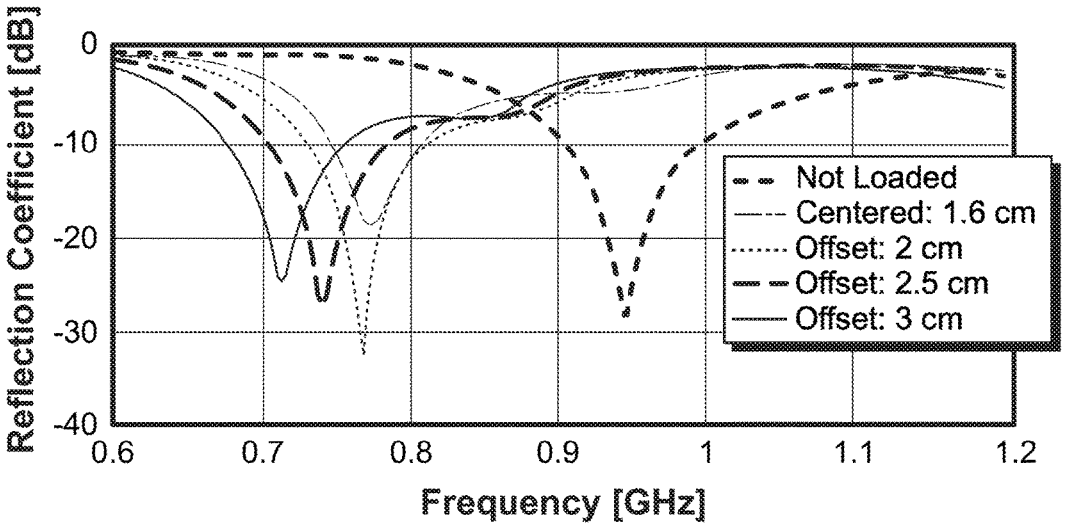
FIG. 5A shows the antenna's reflection coefficient for the offset positioning of the members.

FIG. 5A shows that the centered positioning with $r_{center}$=1.6 cm gives the same resonant frequency as the offset case with $r_{offset}$=2 cm. However, an improvement in the magnitude of the reflection coefficient is attained since the four circular disks are further apart from each other. Such offset pushes the antenna's input resistance closer to 50Ω. The antenna shifts its resonant frequency to 714 MHz for $r_{offset}$=3 cm while maintaining a maximum gain of 5.7 dB.

Figure 5B:
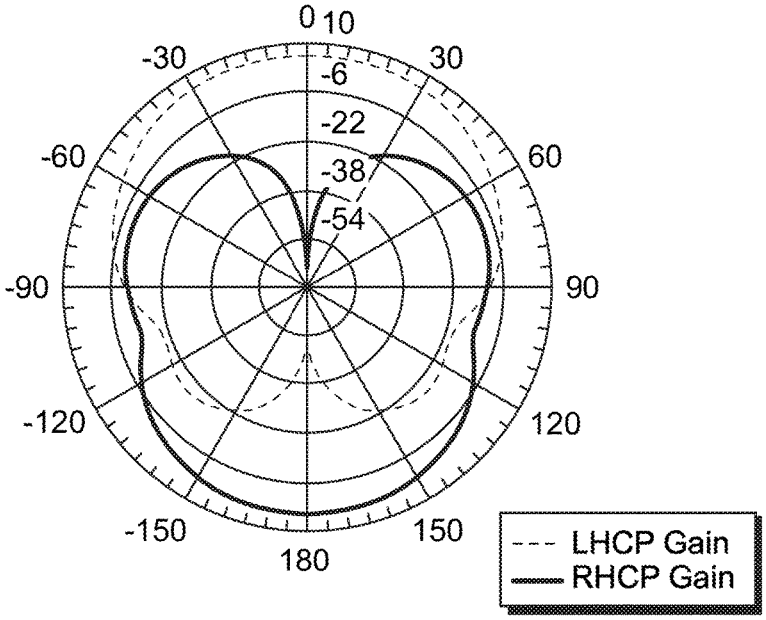
FIG. 5B shows the LHCP and RHCP gain components of the antenna structure with a radius offset of 3 cm.
Figure 6:
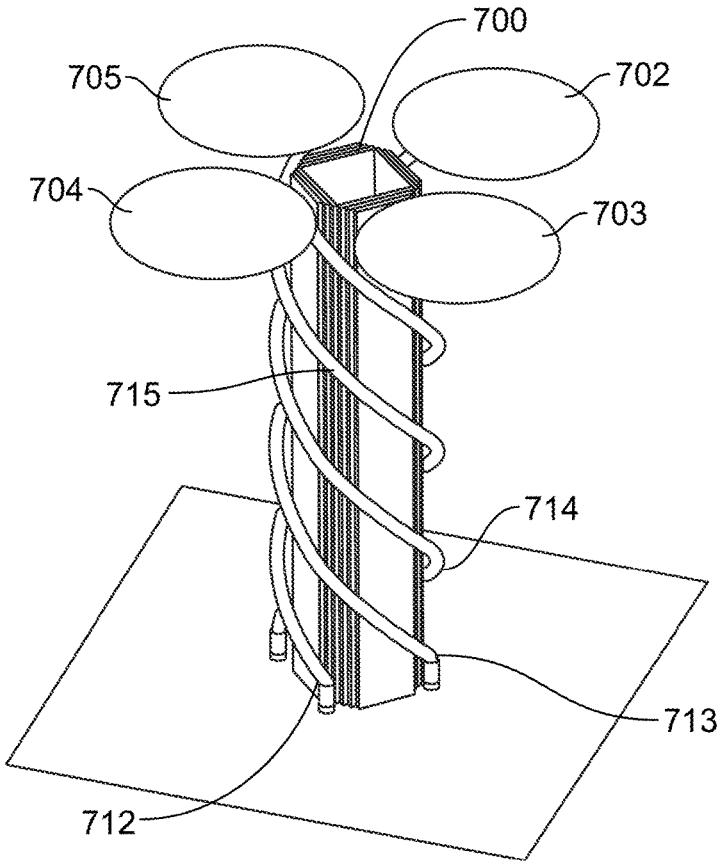
FIG. 6 provides an antenna design with offset circular members or elements as well as integrated dielectric slabs for another embodiment of the present invention.

The offset loading of the four helical arms does not affect the left-hand circular polarization feature of the antenna structure. FIG. 5B shows for $r_{offset}$=3 cm the left and right-handed gain pattern along the XZ-plane. For −60°<θ<60°, the LHCP gain varies between 0 dB and 5.5 dB. As for the RHCP gain, it spans from −63 dB to −10 dB. This difference between the two gain components confirms the LHCP feature of the offset loaded antenna structure. As for the back lobe (at θ=180°), the LHCP gain is −51.26 dB while the RHCP gain is 3.94 dB.

Figure 7A:
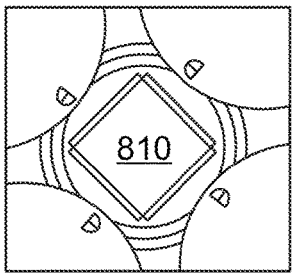
FIGS. 7A, 7B and 7C are top views of various placements of dielectric materials that may be used with the embodiment shown in FIG. 6.
Figure 7B:
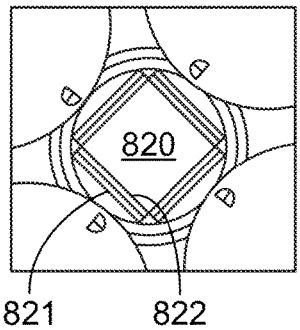
Figure 7C:
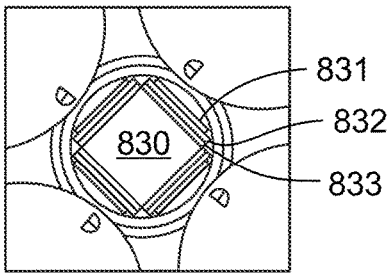
Figure 8:
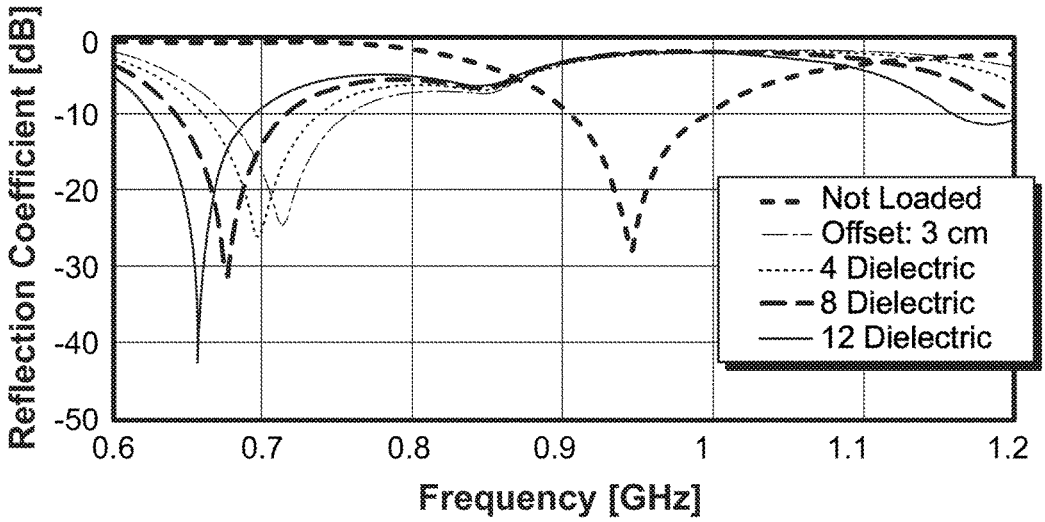
FIG. 8 shows the antenna reflection coefficient of the embodiments shown in FIGS. 7A-7C.

FIG. 6 and FIGS. 7A-7C illustrate how dielectric loading may be accomplished for various embodiments of the present invention. In a preferred embodiment, a dielectric material 700, which may be FR-4, is located in the interior space between elements 702-705 and helix arms 712-715. As shown in FIG. 7A, the dielectric material may be in the form of housing 810, which may be rectangular, tubular or in other shapes as known to those of skill in the art. In other embodiments, as shown in FIG. 7B, housing 820 may be comprised of outer walls 821 and inner walls 822. In yet other embodiments, as shown in FIG. 7C, housing 830 may include a plurality of walls 831-833. which may be stepped in design.

In a preferred embodiment, the inner housings may have the dimensions of 16.924×2.4×1.6 $cm^3$ and the outer housings may have dimensions of 16.924×2.2×1.6 $cm^3$. The ground plane dimensions may be 16×16 $cm^2$, and the circular elements may be offset with a radius of 3 cm.

In yet other embodiments, the inner housings may be 12×1.68 $cm^2$ each while the outer housings may be 12×1.38 $cm^2$. In further embodiments, each slab has a length of 16.92 cm and a width of 2.4 cm with a thickness of 0.16 cm. For the embodiment of FIG. 7C, the last four added slabs or panels have a smaller width of 2.2 cm in order to guarantee that no intersection occurs with the four helical arms. This creates a stepped design.

Figure 9:
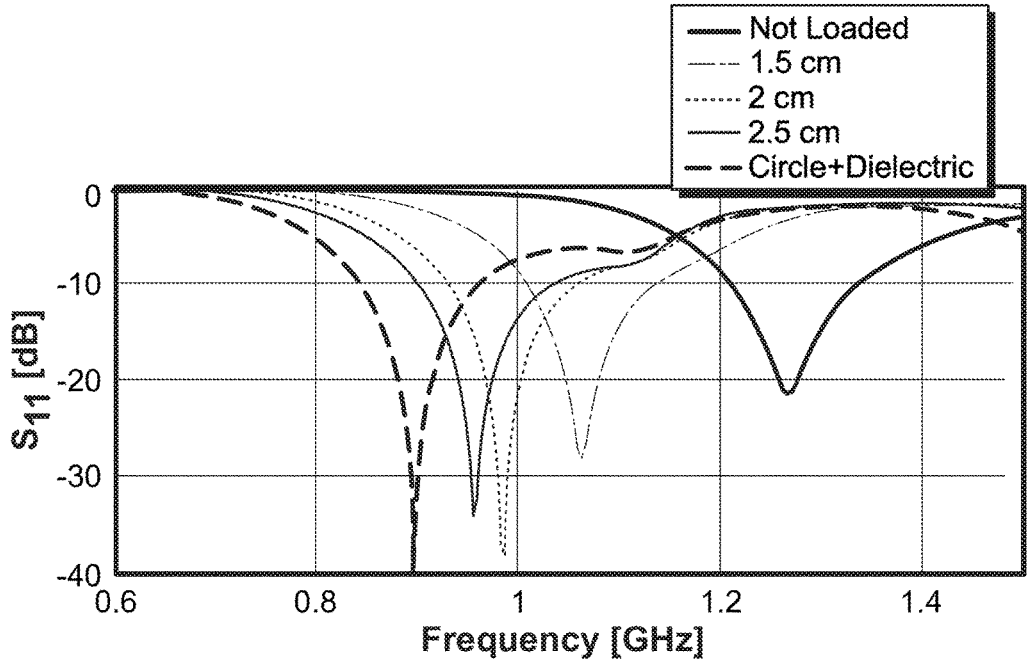
FIG. 9 shows the performance results for another embodiment of the present invention.

The addition of the dielectric slabs has the effect of slowing the traveling wave along the four helical arms which in turn affects the antenna's resonant frequency. The corresponding reflection coefficient for the antennas of FIGS. 7A-7C is shown in FIG. 9. The resonant frequency of the antenna decreases with the added thickness of the dielectric slabs. The dielectric slabs also improve the antenna's matching conditions by decreasing the magnitude of the reflection coefficient to less than −40 dB for the third scenario at the resonant frequency of 667 MHz. In addition to that, the dielectric slabs' loading also lowers the antenna radiation efficiency which in turns affects the total maximum realized gain. For the first scenario, the maximum gain drops to 5.46 dB. This gain reduces to 5.35 dB and then to 5.01 dB for the second and third scenario respectively. Thus, the addition of more dielectric slabs can further reduce the antenna's resonant frequency but at the expense of deteriorating the total antenna gain.

An unloaded (no circular elements and no dielectric slabs) quadrifilar helix antenna that resonates at 667 MHz has the following dimensions: Hd=4.547 cm, Hs=25.5 cm, and N=1.1. These dimensions are optimized for the same helix diameter as the initial antenna structure at 945 MHz. The antenna's corresponding total length is 28.05 cm. Thus, a 43% reduction in the total antenna length is achieved by combining the two miniaturization techniques.

In other embodiments, the antenna of the present invention may be dimensioned as follows: 1—Helix Diameter (Hd): 4.547 cm→3.323 cm; 2—Helix Spacing ($H_s$): 14.632 cm→10.692 cm; 3—Nb of Turns: 1.1→Remains the same; 4-Wire Diameter: 0.5 cm→Remains the same; 5—Ground Plane: 16×16 $cm^2$→Remains the same. Also, the elements offset circular elements with radius 2.5 cm and eight vertical FR4 boxes: −12×1.68×0.16 $cm^3$−12×1.38×0.16 $cm^3$. The performance results of this embodiment are shown in FIG. 9.

Figure 10:
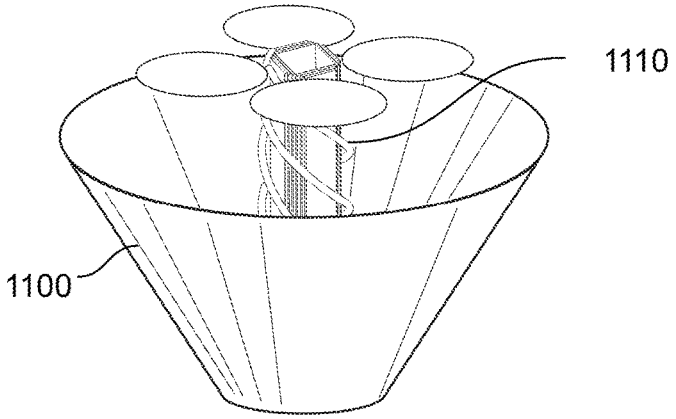
FIG. 10 shows another embodiment of the present invention with a conical shaped ground plane of length L.
Figure 11:
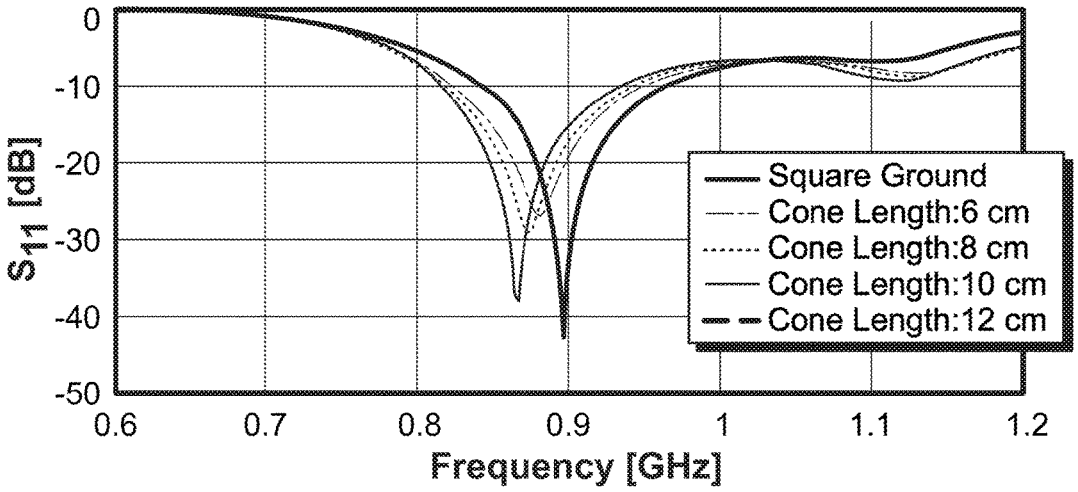
FIG. 11 shows the reflection coefficient for various values of the length L of the cone shaped ground plane of the embodiment shown in FIG. 10.

FIG. 10 depict yet another embodiment of the present invention. As shown, the planar ground plane may be changed to a volumetric structure 1100. In a preferred embodiment, the ground plane is a cone which may vary in length. The length of the cone L may be 25%, 50%, 75% the height of arm 1110. The length of the cone may also be equal to the height of the arm. In other aspects, the cone may have an inner radius of 3 cm and outer radius of 9 cm. The reflection coefficient for various values of the length L of the cone shaped design is shown in FIG. 11.

In one preferred embodiment, the present invention provides a miniaturized quadrifilar helix antenna to operate within the upper UHF band between 800 MHz and 1000 MHz. For this embodiment, a quadrifilar helix antenna that resonates at 1266 MHz in its unloaded configuration is designed first. The unloaded antenna's helix diameter is $H_d$=3.323 cm with a helix pitch $H_p$=10.692 cm, and a number of turns of N=1.1. The antenna ground plane is also chosen to be 16 cm×16 cm. The corresponding reflection coefficient is presented in FIG. 9.

The four arms of the antenna may be loaded with an offset circular disks of radius 2.5 cm as described above. The radii of the loading conductive circular elements are chosen to be equal to 2.5 cm due to the fact that the unloaded antenna's helix diameter is 3.323 cm for an operation at 1266 MHz. Any increase of the circular elements' radii beyond 2.5 cm will force them into contact with each other which will affect the antenna performance and matching. In the space between the helical arms, eight vertical FR4 slabs are included as also described above. Each slab has a length of 12 cm and a width of 1.68 cm. The four circular elements shift the antenna resonant frequency from 1266 MHz to 957 MHz. The addition of the dielectric slabs allows the antenna resonant frequency to become 897 MHz with an operating bandwidth from 838 MHz up till 964 MHz as detailed in FIG. 9.

The miniaturized antenna design can be further improved by optimizing the shape, dimensions, and topology of the ground plane. Changing the ground plane from a planar square shape into a more directional enforcing volume structure can have a positive impact on the compactness of the antenna structure as well as the gain of the resulting structure. The ground plane may be molded into a conical shape. FIG. 10 shows an antenna structure with a length L=10 cm. The cone has an inner radius of 3 cm and an outer radius of 9 cm. The cone's inner radius is taken to be the smallest possible in order to be able to accommodate the four SMA connectors that feed the four antenna arms.

The length L of the cone was analyzed to ensure that optimal performance is achieved. The input reflection coefficient for various L values is summarized in FIG. 11.

Figure 12:
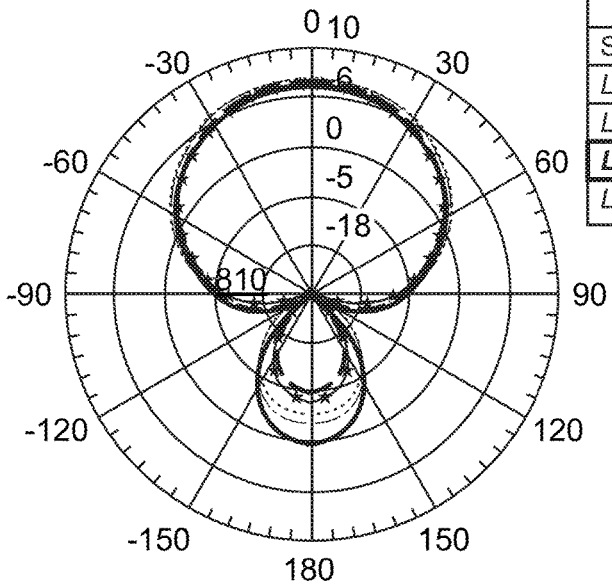
FIG. 12 shows the 2D total gain pattern for various values of L in the XZ plane along with the maximum and back lobe gains for each case in addition to the square ground plane.

The antenna maintains almost the same operating bandwidth with a little noticeable shift in the resonant frequency for various values of L The best matching is obtained for L=10 cm with a shift in the resonant frequency from 897 MHz to 867 MHz. The effect of the cone length is more apparent in the antenna gain pattern shown in FIG. 12. In the case of the square ground plane (16 cm×16 cm), the antenna produces a maximum total gain of 6.11 dB at θ=0° and the back lobe gain at θ=180° is 0.28 dB. The cone shaped ground plane improves the gain levels in the main beam while at the same time reducing the back lobe gain for different values of L. The different values are also highlighted in the table in FIG. 12. It is noticed that for L=12 cm, the maximum total gain drops to 5.48 dB. This is obtained since the length of the cone is almost equal to the total length of the antenna. The cone with a length L=10 cm is chosen as a compromise between the maximum gain level and minimum back lobe radiation. This length achieves a maximum gain of 6.28 dB at θ=0° and a back lobe gain of −4.06 dB at θ=180°.

Figure 13:
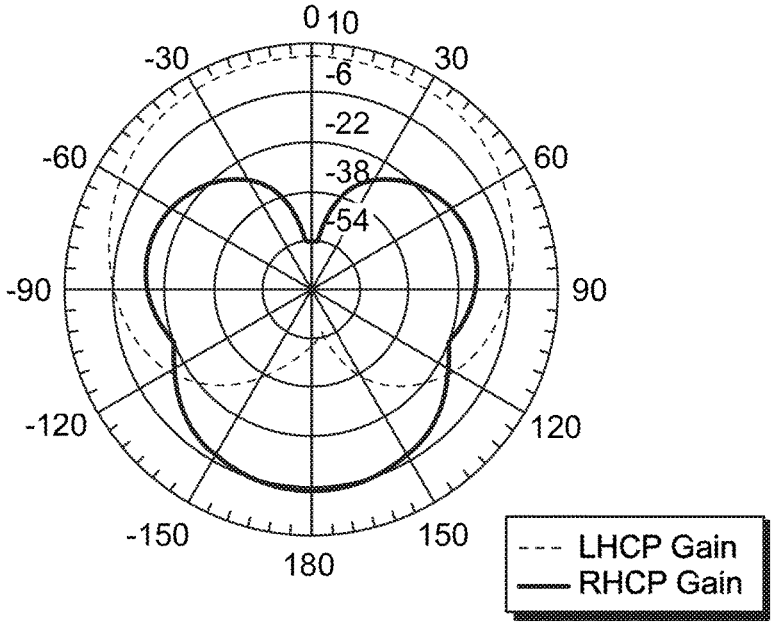
FIG. 13 shows the 2D LHCP and RHCP gain pattern in the XZ plane at f=867 MHz of the embodiment shown in FIG. 10 with L=10 cm.

The 2D LHCP and RHCP gain patterns for the antenna structure with the cone shaped ground plane (L=10 cm) are shown in FIG. 13. The RHCP gain levels are negative for the whole span of θ angles and reduce to less than −22 dB in the antenna's main beam. As for the LHCP gain, the positive gain levels are focused −60°<θ<60°. The difference between the two gain components is around 60 dB at θ=0° and around 58 dB at θ=180°. The surface current density along the cone shaped ground rotates in the clockwise direction. This indicates that the ground plane contributes constructively in achieving left handed circular polarized radiation. The polarization scheme can be flipped if the sense of winding of the helical arms is in the counter clockwise direction and the phase shift between the input ports is oriented in a clockwise manner.

To ensure the antenna radiates accurately, the four helical arms are fed with the same power and with a 90° progressive phase shift. This can be achieved by relying on one 180° power splitter and two 90° power splitters. The feeding network exhibits an operating bandwidth between 600 MHz and 1200 MHz with an insertion loss of around −7 dB between the input of the network and one of the four outputs.

Figure 14A:
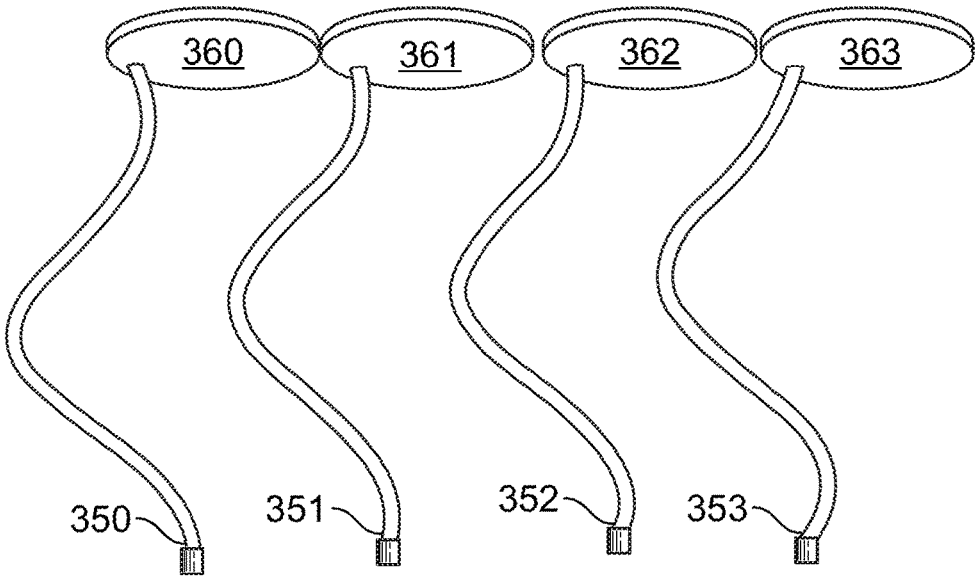
FIG. 14A illustrates helical arms that are 3D printed and used with embodiments of the present invention.
Figure 14B:
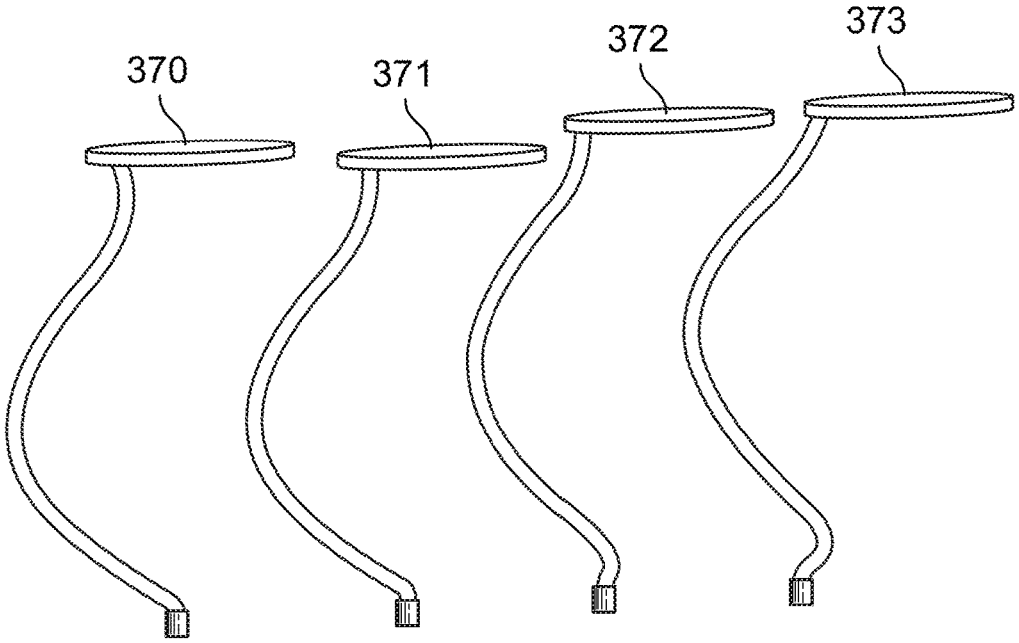
FIG. 14B illustrates wrapped 3D printed helical arms that may be used with embodiments of the present invention.

FIG. 14A illustrates nonconductive arms 350-353 and elements 360-363, which may be made from plastic or nonmetallic materials. For this embodiment of the present invention, each helical arm and member may be 3D printed using a laser based technique to form a non-conductive substrate. The material that is used may be Polyactic acid with a dielectric constant of 3.1. The substrate may then have an outer conductive layer. For one embodiment, the outer conductive layer may be adhesive copper wrappings which may be used to coat the substrate as shown in FIG. 14B. The thickness of the copper wrappings is chosen carefully to be at least ten times thicker than the copper skin depth at the antenna's resonant frequency. Two additional approaches are also executed on the four helical arms. The first one is based on spraying the arms with conductive paint and the second one is based on using electroplating. For the different approaches, the four helical arms can produce a continuous path for the excited current.

Figure 15:
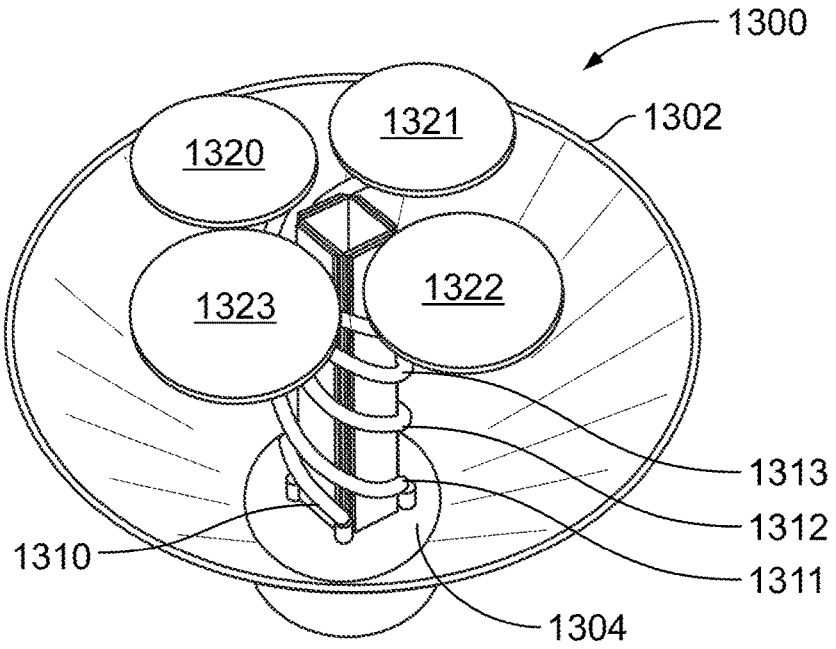
FIG. 15 provides the fabricated antenna design for the present invention.
Figure 16:
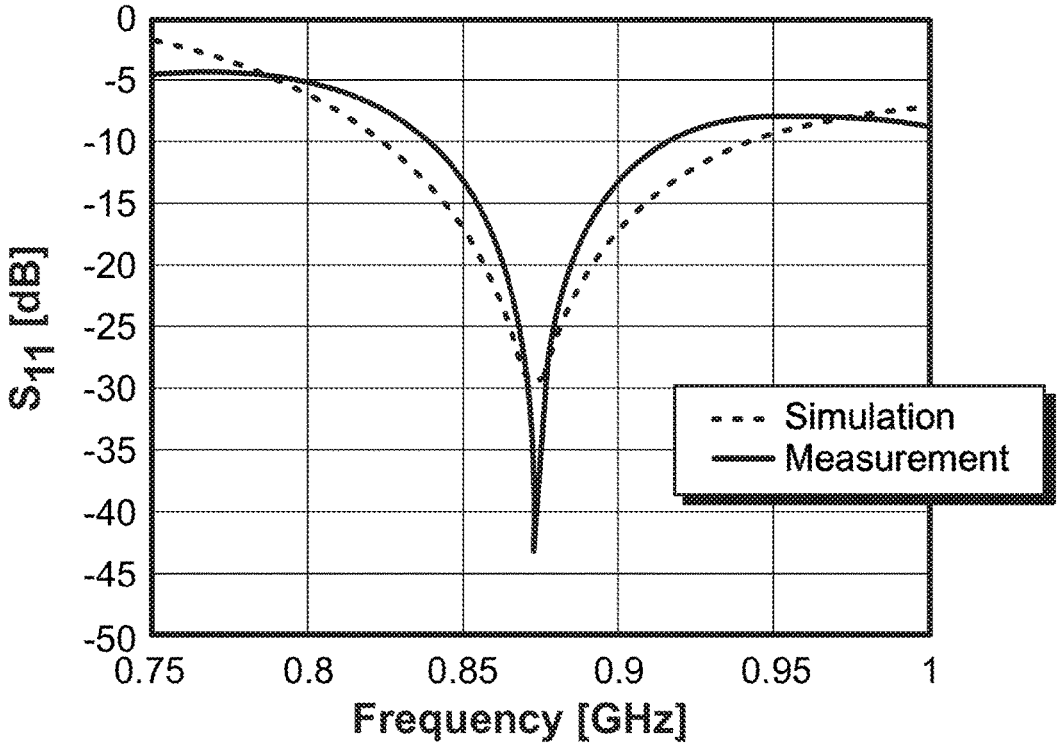
FIG. 16 shows the performance results of the embodiment shown in FIG. 15.

FIG. 15 depicts a preferred embodiment of the present invention. As shown, antenna 1300 is comprised of volumetric structure 1302, which may be a cone having a base 1304. Also, include are helical arms 1310-1314 and loading elements 1320-1323 which located at the terminal ends of the arms. A dielectric material 1330 may be located between the arms. The performance results of this embodiment are shown in FIG. 16, which is a comparison between the simulated and measured antenna reflection coefficient. The agreement between both data proves the validity of the embodiments of the present invention. Accordingly, the embodiments of the present invention may be used in applications that necessitate compactness, acceptable gain and circular polarization. An example of such applications can be small and nano-satellites.

The antenna fabrication is initiated by shaping a planar brass sheet of thickness 0.25 cm into a conical form as depicted in FIG. 15. The bottom circular part of the ground plane is fabricated separately where four holes are drills to accommodate the four connectors required to feed the 3D printed helical arms. Eight dielectric slabs are then attached to the circular part as described above. These slabs also act as a support for the four 3D printed helical arms.

Figure 17A:
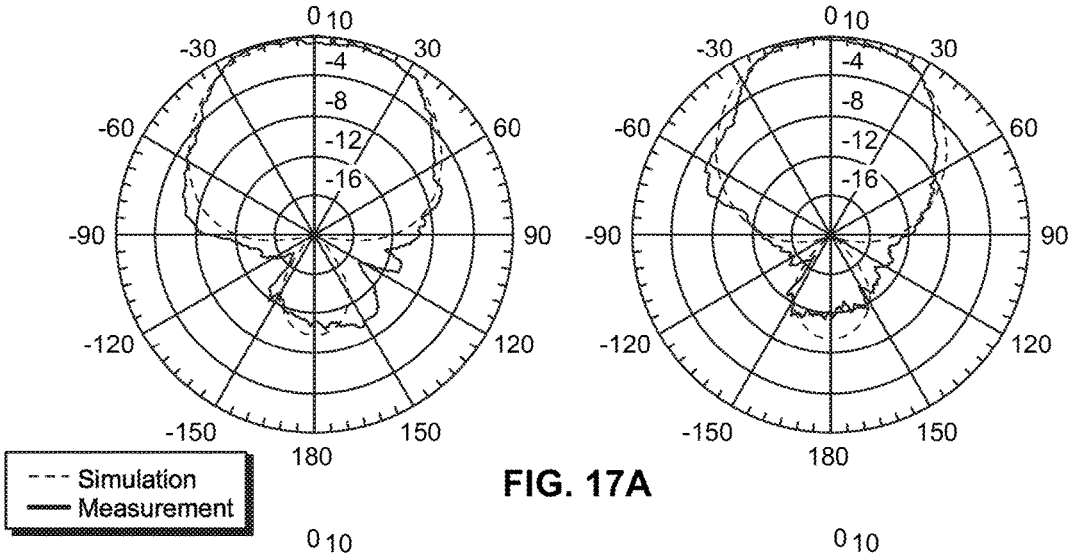
FIGS. 17A, 17B and 17C provide comparisons between the simulated and measured radiation pattern for the vertical (left plot) and horizontal (right plot) polarization at (a) 840 MHz, (b) 870 MHz, (c) 900 MHz.
Figure 17B:
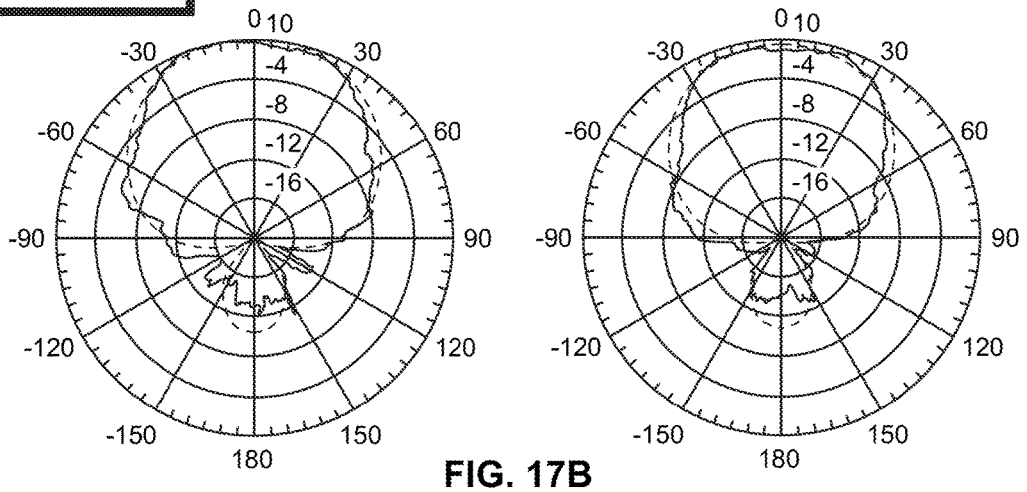
Figure 17C:
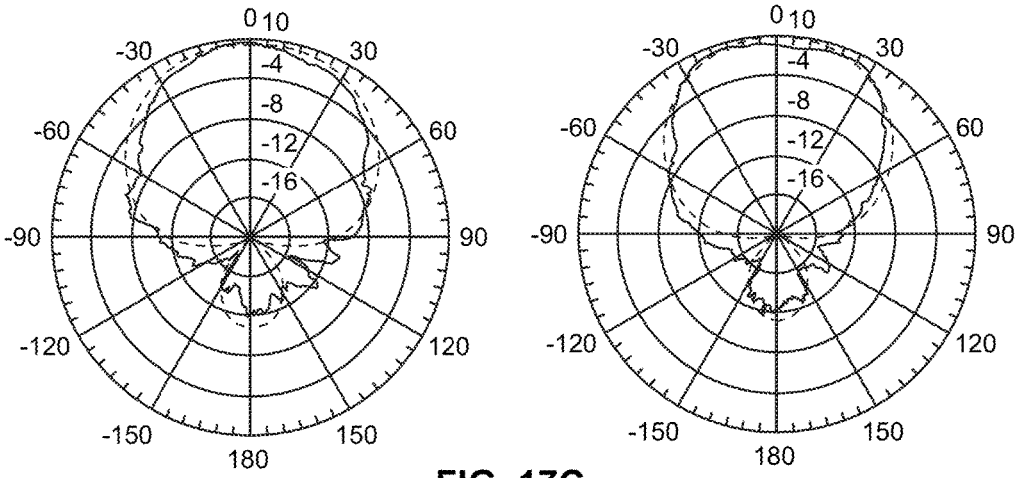

The comparison between the simulated and measured antenna reflection coefficient is presented in FIG. 16. The simulated data is computed by modeling the antenna with the power splitters by their corresponding S-Parameters matrices and by accounting for the effect of the transmission lines. A good agreement is found between the simulated and measured results. The fabricated prototype covers the bandwidth from 835 MHz-930 MHz. The simulated and measured normalized antenna radiation pattern in the XZ-plane for f=840 MHz, 870 MHz, and 900 MHz are shown in FIGS. 17A-17C. For each frequency, the data presented in the left plot corresponds to the vertical polarization case while the one in the right plot represents the horizontally polarized component. Both polarizations produce almost the same pattern for the three different frequencies.

The measured antenna RHCP and LHCP gain values are presented in Table I for f=840 MHz, 870 MHz and 900 MHz at various θ angles (0°, 15°, 30°, 45°, 60°) in the ϕ=0° plane.

TABLE I

The measured antenna gain [dB] for both polarizations (LHCP/RHCP) at various θ angles in the ϕ = 0° plane

| Freq [MHz] | Pol. | θ = 0° | θ = 15° | θ = 30° | θ = 45° | θ = 60° |
|---|---|---|---|---|---|---|
| 840 | LHCP | 6.4 | 6.2 | 5.1 | 3.3 | 0.6 |
| | RHCP | −45.8 | −42.8 | −28.3 | −22.2 | −18.3 |
| 870 | LHCP | 6.4 | 5.8 | 4.7 | 2.9 | 0.3 |
| | RHCP | −54.5 | −40.7 | −28.2 | −22.4 | −18.5 |
| 900 | LHCP | 6.1 | 5.5 | 4.3 | 2.6 | −0.1 |
| | RHCP | −62.1 | −40.8 | −28.8 | −23.1 | −19.2 |

Figure 18:
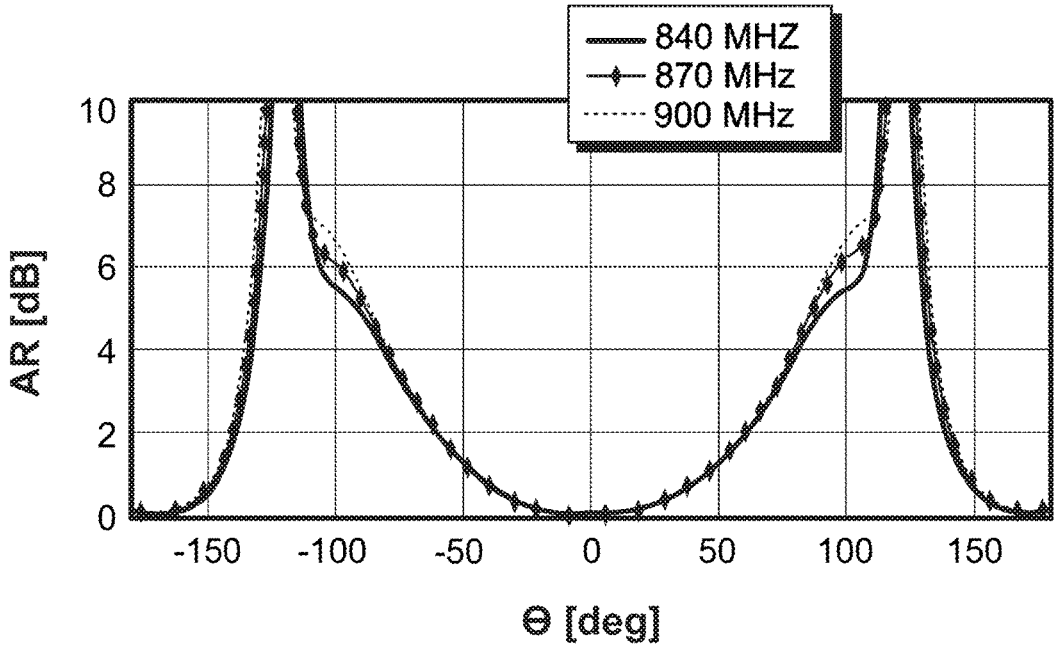
FIG. 18 depicts the fabricated antenna's axial ratio for three different frequencies along the XZ cut plane.

The high isolation levels between the two circularly polarized gain components demonstrate the LHCP behavior in the antenna's main beam. The simulated gain values exhibit close agreement with the measured ones. For example, at 840 MHz, 870 MHz, and 900 MHz the LHCP simulated gain levels are 6.5 dB, 6.2 dB, and 5.8 dB respectively for θ=0° and ϕ=0°. Such agreement is obtained since the entire insertion loss of the feeding system is taken into consideration in the simulation environment. This is achieved by forcing the excitation signals that feed the four arms to be the same as the four outputs of the feeding system for the whole span of frequencies. Such response guarantees that an LHCP behavior is maintained within the operating bandwidth of the presented antenna structure. To further investigate the circularly polarized feature of the fabricated prototype, the axial ratio is presented in FIG. 18 for the three different frequencies presented in Table I along the XZ cut plane. A level below 3 dB is maintained within the antenna operating beamwidth (−60°<θ<+60°) for the three frequencies. The measurement uncertainties are also computed by taking into account four different factors. These factors are the proximity correction, the random effects, and the uncertainty in the power source during measurement, as well as the multipath propagation inside the anechoic chamber. It is found that the overall measurement uncertainty is ±0.4 dB with a 99% confidence level. This value is obtained by taking 7 different separation distances between the transmitter and the receiver (1.5 m to 4.5 in a step of 0.5 m) and by performing 15 different consecutive measurements for each distance.

While the foregoing written description enables one of ordinary skill to make and use what is considered presently to be the best mode thereof, those of ordinary skill will understand and appreciate the existence of variations, combinations, and equivalents of the specific embodiment, method, and examples herein. The disclosure should therefore not be limited by the above-described embodiments, methods, and examples, but by all embodiments and methods within the scope and spirit of the disclosure.

What is claimed is:

1. A quadrifilar helix antenna comprising:

a plurality of arms each having a first end and an oppositely located second end;

a ground plane;

a plurality of conductive members;

each of said arms and conductive members have a non-conductive substrate and a conductive outer layer; and each second end of an arm connected to a conductive member.

2. The quadrifilar helix antenna of claim 1 wherein said conductive members are planar disks.

3. The quadrifilar helix antenna of claim 2 wherein said arms are connected to said planar disks at the center of said disks.

4. The quadrifilar helix antenna of claim 2 wherein said arms are connected to said planar disks at a position offset from the center of the disk.

5. The quadrifilar helix antenna of claim 2 wherein said arms are connected to the edges of said planar disks.

6. The quadrifilar helix antenna of claim 1 wherein said ground plane is conical in shape.

7. The quadrifilar helix antenna of claim 1 wherein said arms define an interior space and a dielectric material is located in said interior space.

8. The quadrifilar helix antenna of claim 7 wherein said dielectric material is spaced apart from said arms.

9. The quadrifilar helix antenna of claim 8 wherein said dielectric material forms a housing comprised of panels.

10. The quadrifilar helix antenna of claim 9 wherein said panels form inner and outer walls.

11. The quadrifilar helix antenna of claim 10 wherein said walls form a stepped configuration.

12. The quadrifilar helix antenna of claim 1 wherein each of said arms are helical in configuration.

13. The quadrifilar helix antenna of claim 12 wherein said outer conductive layer is an adhesive copper wrapping having a thickness at least ten times thicker than the copper skin depth at the antenna's resonant frequency.

14. The quadrifilar helix antenna of claim 1 wherein the antenna maintains a left handed circular polarized behavior over the entire operational bandwidth.

15. The quadrifilar helix antenna of claim 1 wherein the antenna realizes a maximum gain of 6.4 dB with an axial ratio below 3 dB across the full operation bandwidth and the total beamwidth.

16. A quadrifilar helix antenna comprising:

a plurality of arms each having a first end and an oppositely located second end, said arms form an interior space;

a conical ground plane;

a plurality of conductive members, said conductive members are planar disks;

each second end of an arm connected to a conductive member;

each of said arms and conductive members have a non-conductive substrate and a conductive outer layer; and a housing made of dielectric material located in said interior space.

17. The quadrifilar helix antenna of claim 16 wherein said housing is spaced apart from said arms.

18. The quadrifilar helix antenna of claim 17 wherein said housing includes panels that form inner and outer walls.

19. The quadrifilar helix antenna of claim 18 wherein said walls form a stepped configuration.

20. The quadrifilar helix antenna of claim 16 wherein said arms are connected to said planar disks at the center of said disks.

21. The quadrifilar helix antenna of claim 16 wherein said arms are connected to said planar disks at a position offset from the center of the disk.

22. The quadrifilar helix antenna of claim 16 wherein said arms are connected to the edges of said planar disks.

23. The quadrifilar helix antenna of claim 16 wherein each of said arms are helical in configuration.

24. The quadrifilar helix antenna of claim 16 wherein the antenna maintains a left handed circular polarized behavior over the entire operational bandwidth.

25. The quadrifilar helix antenna of claim 16 wherein the antenna realizes a maximum gain of 6.4 dB with an axial ratio below 3 dB across the full operation bandwidth and the total beamwidth.

* * * * *